US006208820B1

(12) United States Patent
Nami

(10) Patent No.: US 6,208,820 B1
(45) Date of Patent: Mar. 27, 2001

(54) ELECTROPHOTOGRAPHIC APPARATUS HAVING PRE-EXPOSURE MEANS

(75) Inventor: Yasuo Nami, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/459,948

(22) Filed: Dec. 14, 1999

(30) Foreign Application Priority Data

Dec. 17, 1998 (JP) ..... 10-375752

(51) Int. Cl.[7] ..... G03G 15/00; G03G 21/00; G03G 21/08

(52) U.S. Cl. ..... 399/128; 399/46; 399/48

(58) Field of Search ..... 399/128, 46, 48, 399/50, 51, 169

(56) References Cited

U.S. PATENT DOCUMENTS 5,565,963 * 10/1996 Tsujita et al. ..... 399/48
5,583,616 * 12/1996 Yamamoto et al. ..... 399/51
5,734,948 * 3/1998 Nagayama et al. ..... 399/46

* cited by examiner

*Primary Examiner*—Sophia S. Chen
(74) *Attorney, Agent, or Firm*—Fitzpatrick, Cella, Harper & Scinto

(57) ABSTRACT

The present invention relates to an electrophotographic apparatus in which the apparatus is provided with a sequence in which a dark portion and a light portion are formed on a first portion and a second portion, respectively, on a photosensitive member by an electrostatic image forming device, whereafter the first portion and the second portion are exposed by a pre-exposure device, and then the first portion and the second portion are charged by a charger, and then a surface potential of the first portion and the second portion are detected by a detector, and an exposure amount at which the photosensitive member is exposed by the pre-exposure device is controlled in conformity with the potential of the first portion and the potential of the second portion detected by the detector in the sequence.

11 Claims, 7 Drawing Sheets

ELECTROPHOTOGRAPHIC APPARATUS HAVING PRE-EXPOSURE MEANS

BACKGROUND OF THE INVENTION

1. Field of the Invention

This invention relates to an electrophotographic apparatus such as a copying machine or printer of the electrophotographic type, and particularly to an electrophotographic apparatus having pre-exposure means for eliminating the residual charges of a photosensitive member.

2. Related Background Art

FIG. 6 of the accompanying drawings schematically shows the construction of an image forming apparatus which is an electrophotographic apparatus according to the prior art. This image forming apparatus is provided with a photosensitive drum 1 which is a photosensitive member rotated in the direction of arrow A, and a photoconductive layer on the surface of this photosensitive drum 1 is uniformly charged by the primary current of a primary charger 2, whereafter it is subjected to the exposure 3 of the optical image of an original and an electrostatic latent image is formed on the surface of the photosensitive drum 1.

The optical image is such that an original placed on original supporting glass 101 is irradiated by a halogen lamp 103 and a reflecting plate 104, and the reflected optical image comes into a zoom lens 110 via reflecting mirrors 105, 102 and 107. It is further irradiated (applied) to the photosensitive drum 1 via reflecting mirrors 106, 108 and 109. At this time, the image is reduced or enlarged by the positional relation between the reflecting mirror 107 and the zoom lens 110.

The electrostatic latent image thus formed comes to a position opposed to a developing device 4 with the rotation of the photosensitive drum 1, and is developed by a toner supplied from the developing device 4 and is visualized as a toner image.

The thus obtained toner image advances to a transfer portion in which a transfer charger 6 is disposed as the photosensitive drum 1 is rotated. On the other hand, a transfer material P moved in synchronism with the photosensitive drum 1 is guided to a conveying path 5 and comes to the transfer portion, where the transfer material P is brought into close contact with the surface of the photosensitive drum 1.

At this position, charges of the opposite polarity to the toner are imparted to the back of the transfer material P by the transfer charger 6, and the toner image on the photosensitive drum 1 is shifted and adsorbed onto the transfer material P by an electrostatic force and is thus transferred.

A separating charger 7 is installed on the downstream side of this transfer charger 6 with respect to the direction of movement of the transfer material. The transfer material P to which the toner image has been transferred has its charges lost by the corona discharge by the separating charger 7 and loses its adsorption force to the photosensitive drum 1, and is separated from the photosensitive drum 1 by the help of the elasticity of the transfer material P itself and further the deadweight (gravity) of the transfer material P.

Also, any toner not transferred to the transfer material P and left on the photosensitive drum 1 is scraped off by the blade of a cleaner 9 and is collected into a container, whereafter the photosensitive drum 1 is further rotated and the potential of the electrostatic latent image after the transfer of the toner is eliminated by a pre-exposure lamp 116 as pre-exposure means.

The transfer material P separated from the photosensitive drum 1 is sent to a fixing device 10 by a conveying portion 8 comprising a conveying belt, and passes between a fixing roller 113 and a pressing roller 114, whereby the toner image thereon is fixed.

The rotational speed of the fixing roller 113 feeding the transfer material P at this time and the rotational speed of the photosensitive drum 1 are generally set so as to differ from each other, and usually the rotational speed of the fixing roller 113 is made a little lower than the rotational speed of the photosensitive drum 1.

This is for preventing any deviation from being caused in the transfer of the toner image to the trailing end portion of the transfer material P which is still in the transfer portion by the shock when the leading end of the transfer material P rushes into the nip portion between the fixing roller 113 and the pressing roller 114.

The transfer material P on which the toner image has been fixed is then discharged out of the apparatus.

Also, when particularly under high humidity environment, moisture adheres onto the photosensitive drum 1, the electrostatic latent image thereon may be blurred, and in order to prevent this, an on-surface heat generating member 119 as means for evaporating the moisture on the photosensitive drum 1 is disposed in the photosensitive drum 1.

In such an image forming apparatus, in order to stabilize the potential on the photosensitive drum 1, the potential of dark portion and the potential of light portion have been formed on the photosensitive drum 1 and have been read by a potential sensor 111, and the amount of image exposure of the halogen lamp 103 and the amount of charging of the primary charger 2 have been changed and set so that this potential may become predetermined potential, and ideal potential has been formed on the photosensitive drum 1.

The potential has been set by the use of such control with the result that the potential of dark portion and the potential of light portion can be controlled and stable image formation becomes possible, but when the image forming operation is continuously performed, an image memory (ghost image) by residual potential is created by the potential difference between the potential of dark portion and the potential of light portion at a location whereat the photosensitive drum 1 has made a round and an electrostatic latent image has been previously formed.

SUMMARY OF THE INVENTION

It is an object of the present invention to provide an electrophotographic apparatus in which poor images by the previous residual potential on a photosensitive member are prevented.

It is another object of the present invention to provide an image forming apparatus in which the amount of exposure of pre-exposure means and the amount of charging of charging means are controlled to thereby prevent the creation of an image memory.

Other objects and features of the present invention will become more fully apparent from the following detailed description when read with reference to the accompanying drawings.

DESCRIPTION OF THE PREFERRED EMBODIMENTS

Some preferred embodiments of the present invention will hereinafter be described in detail with reference to the drawings. However, the dimensions, materials, shapes, relative positions, etc. of constituent parts described in these embodiments, unless specifically specified, are not intended to be restrictive within the scope of the invention.

(First Embodiment)

An image forming apparatus according to a first embodiment will hereinafter be described with reference to FIGS. 1 to 3.

Figure 1:
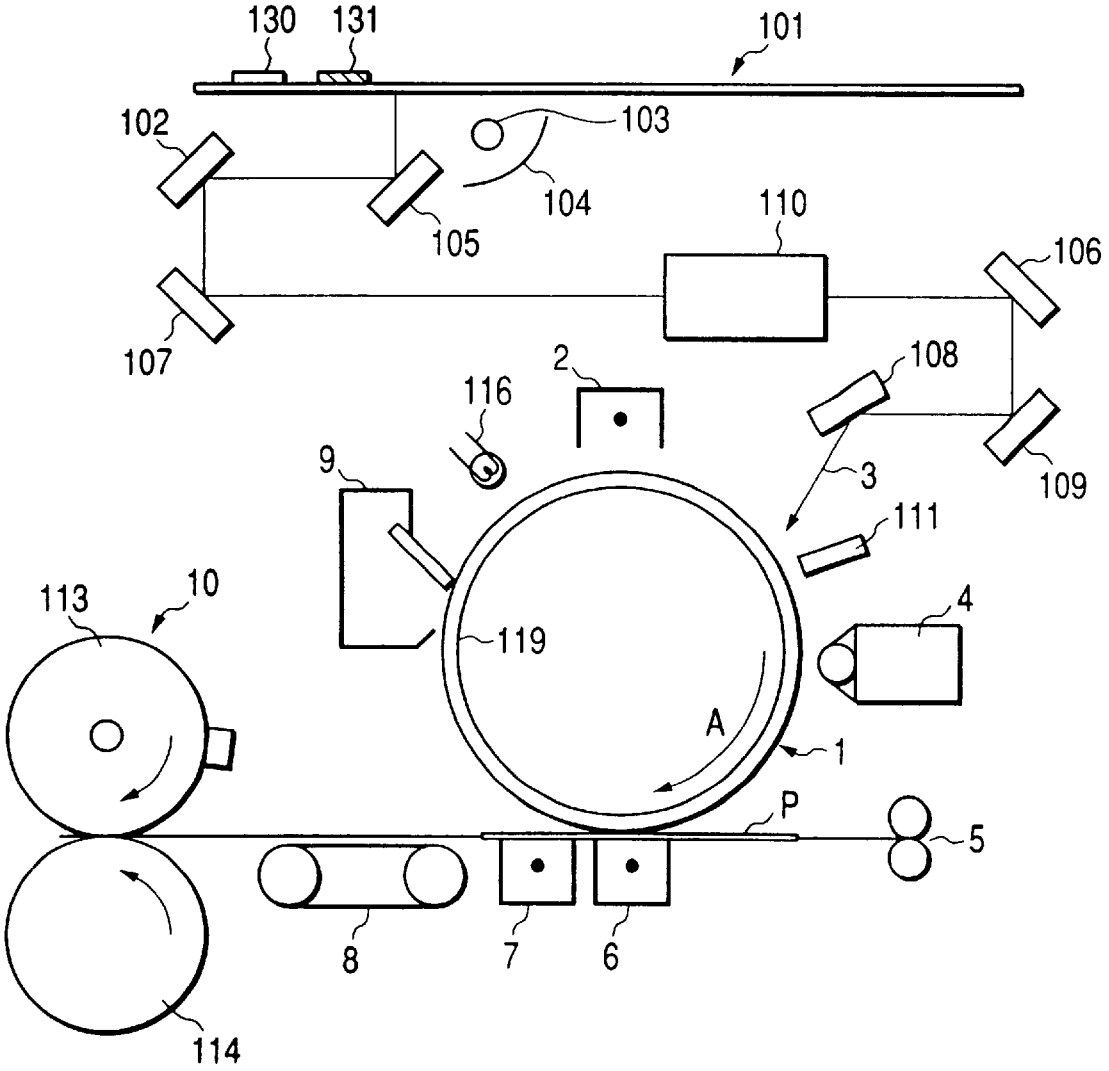
FIG. 1 schematically shows the construction of an image forming apparatus according to a first embodiment of the present invention.
Figure 2:
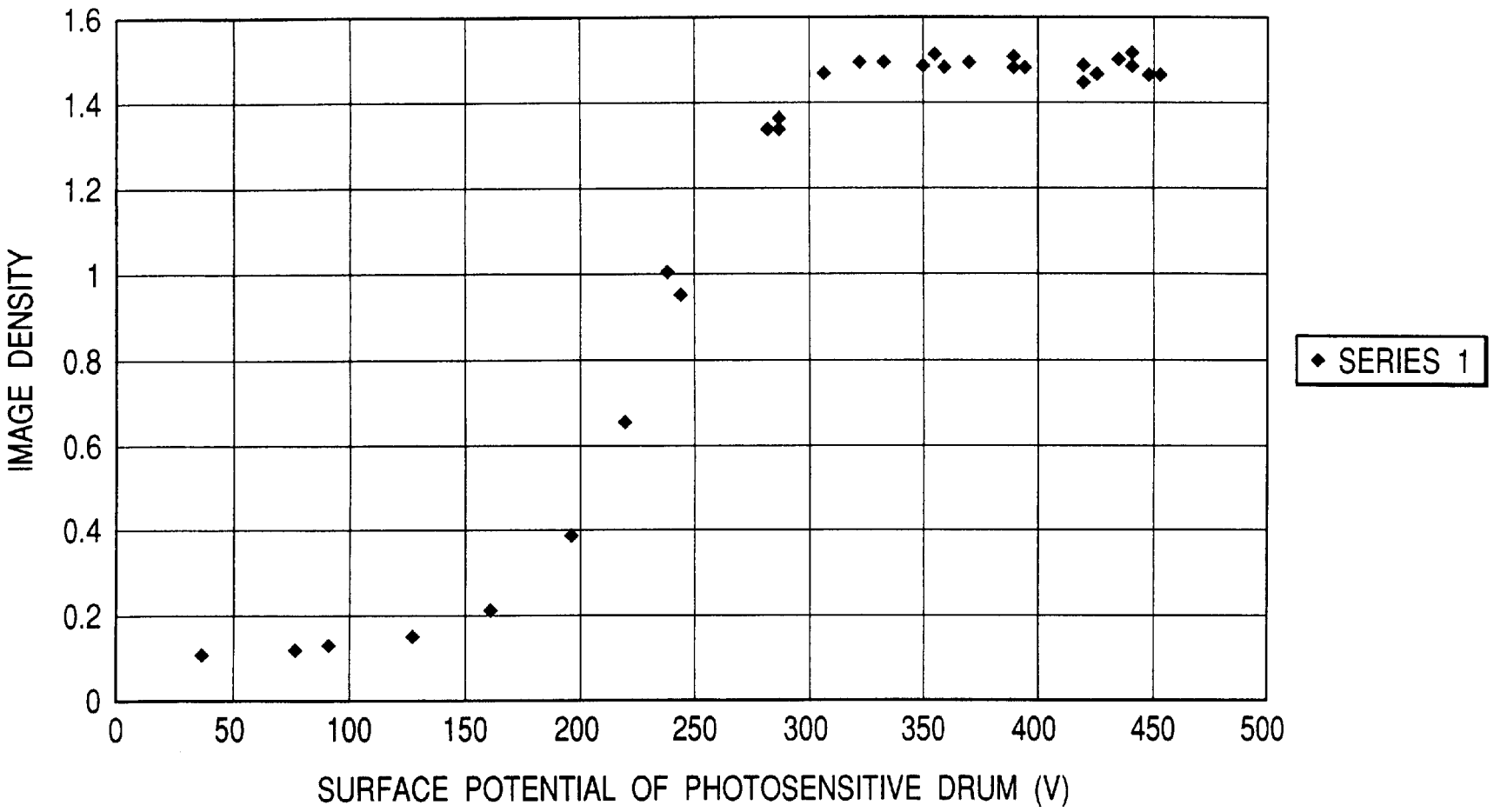
FIG. 2 is a graph showing the relation between the surface potential and image density of a photosensitive drum.

FIG. 1 schematically shows the construction of the image forming apparatus according to the first embodiment. The reference numeral 1 designates a photosensitive drum, the reference numeral 2 denotes a primary charger, the reference numeral 3 designates optical image exposure, the reference numeral 4 denotes a developing device, the reference numeral 5 designates a conveying path, the reference numeral 6 denotes a transfer charger, the reference numeral 7 designates a separating charger, the reference numeral 8 denotes a conveying portion, the reference numeral 9 designates a cleaner, and the reference numeral 10 denotes a fixing device.

In the present embodiment, the constructions and operations of the photosensitive drum 1, etc. are basically the same as those shown in the prior art of FIG. 9 and therefore need not be described. In the present embodiment, the process speed is 300 mm/sec., and the diameter of the photosensitive drum 1 is 100 mm.

In the present embodiment, in order to stabilize the potential on the photosensitive drum 1 before image formation, the potential of dark portion and the potential of light portion are read by a potential sensor 111, and the setting control of changing and setting the amount of image exposure of a halogen lamp 103 and the amount of charging of the primary charger 2 so that this potential may become predetermined potential is effected to thereby form ideal potential.

Thereafter, by the use of the amount of charging of the primary charger 2 and the image exposure amount of the halogen lamp 103 obtained by the above-described setting control before image formation, a first electrostatic latent image for detection is formed in the order of the potential of dark portion in a first portion, the potential of light portion in a second portion and the potential of dark portion in a third portion, and this first electrostatic latent image for detection is not developed by a toner, but is pre-exposed by a pre-exposure lamp 116 and has its charges eliminated thereby, and after one round, the potential detection of reading the residual potential corresponding to each of the first, second and third portions of the first electrostatic latent image for detection on the photosensitive drum 1 by the potential sensor 111 is effected.

After the first electrostatic latent image for detection has been pre-exposed and before the residual potential of the first electrostatic latent image for detection is detected, the first, second and third portions are formed as a second electrostatic latent image of halftone potential. It is because as shown in FIG. 2, changes in the toner image density by the fluctuation of the potential on the photosensitive drum 1 remarkably appear in the halftone potential that the detection of the potential of each of the first portion, the second portion and the third portion is confirmed on the halftone potential. Herein, the halftone potential is the potential at which the toner image density fluctuates by 0.2 or greater by the potential being fluctuated by 50V. The toner image density was measured by the reflection density meter of Macbeth Co. The halftone potential may preferably be potential corresponding to the toner image density of 0.3 to 1.0.

When the detected potential difference between the residual potential of the first portion (or the third portion) and the residual potential of the second portion is a predetermined value of 5V or greater, the pre-exposure light amount changing control of increasing the input voltage of the pre-exposure lamp 116 for eliminating the charges of the electrostatic latent image formed on the photosensitive drum 1 to thereby increase the pre-exposure light amount is effected. The greater is made the quantity of light of the pre-exposure lamp 116, the more difficult it becomes for the trace of the previous image to occur even if a halftone image is formed next.

In the present embodiment, the input voltage inputted to the pre-exposure lamp 116 is set to 20V as a basic value, and the pre-exposure lamp 116 can emit a quantity of light of 4.0 [lux·sec.] at 20V, and the quantity of light rises by 0.8 [lux·sec.] when the input voltage is increased by 1V.

The "lux·sec." used herein is a unit indicative of the product of the intensity of light applied per unit area of the photosensitive drum 1 and time.

So, when the potential difference between the residual potential of the first portion (or the third portion) and the residual potential of the second portion is 5V or greater, the input voltage of the pre-exposure lamp 116 is raised by 1V. It is preferable that dark portions be formed on the first portion and the third portion and the average potential thereof be the potential of dark portion.

When the potential difference between the residual potential of the first portion (or the third portion) and the residual potential of the second portion is within 5V, this pre-exposure light amount is kept so that image formation can be effected. Also, image formation is effected by the use of the amounts determined by the setting control as the amount of charging of the charger 2 and the amount of image exposure of the lamp 103.

Next, when the pre-exposure light amount is raised by the pre-exposure light amount changing control, return is made to the setting control thereafter, and the potential of dark portion and the potential of light portion are read by the potential sensor 111, and the amount of image exposure of the halogen lamp 103 and the amount of charging of the primary charger 2 are changed so that this potential may become predetermined potential, and ideal potential is formed.

As the result of the pre-exposure light amount by the lamp 116 having been raised, the amount of charging of the primary charger 2 is raised to thereby ensure the potential of dark portion, and the potential difference of the residual potential always becomes small, and the formation of images of high quality becomes possible.

Thereafter, as previously described, a first electrostatic latent image for detection is formed in the order of the potential of dark portion, the potential of light portion and the potential of dark portion, and the potential detection of reading the residual potential on the photosensitive drum 1 after one round on which a second electrostatic latent image of halftone potential has been formed by the potential sensor 111 is effected.

When the potential difference of this detected residual potential is 5V or greater, the pre-exposure light amount changing control of raising the input voltage of the pre-exposure lamp 116 by 1V to thereby raise the pre-exposure light amount is effected.

In this manner, from the setting control, potential detection and pre-exposure light amount changing control are repetitively effected so that image formation can be effected after the potential difference of the residual potential detected by the potential difference detecting control has been set so as to be within 5V.

This control will be described in greater detail with reference to FIG. 3. In the present embodiment, the halftone potential for measuring the potential difference among the potential of dark portion 470V, the potential of light portion 50V and the residual potential is set to 200V.

Figure 3:
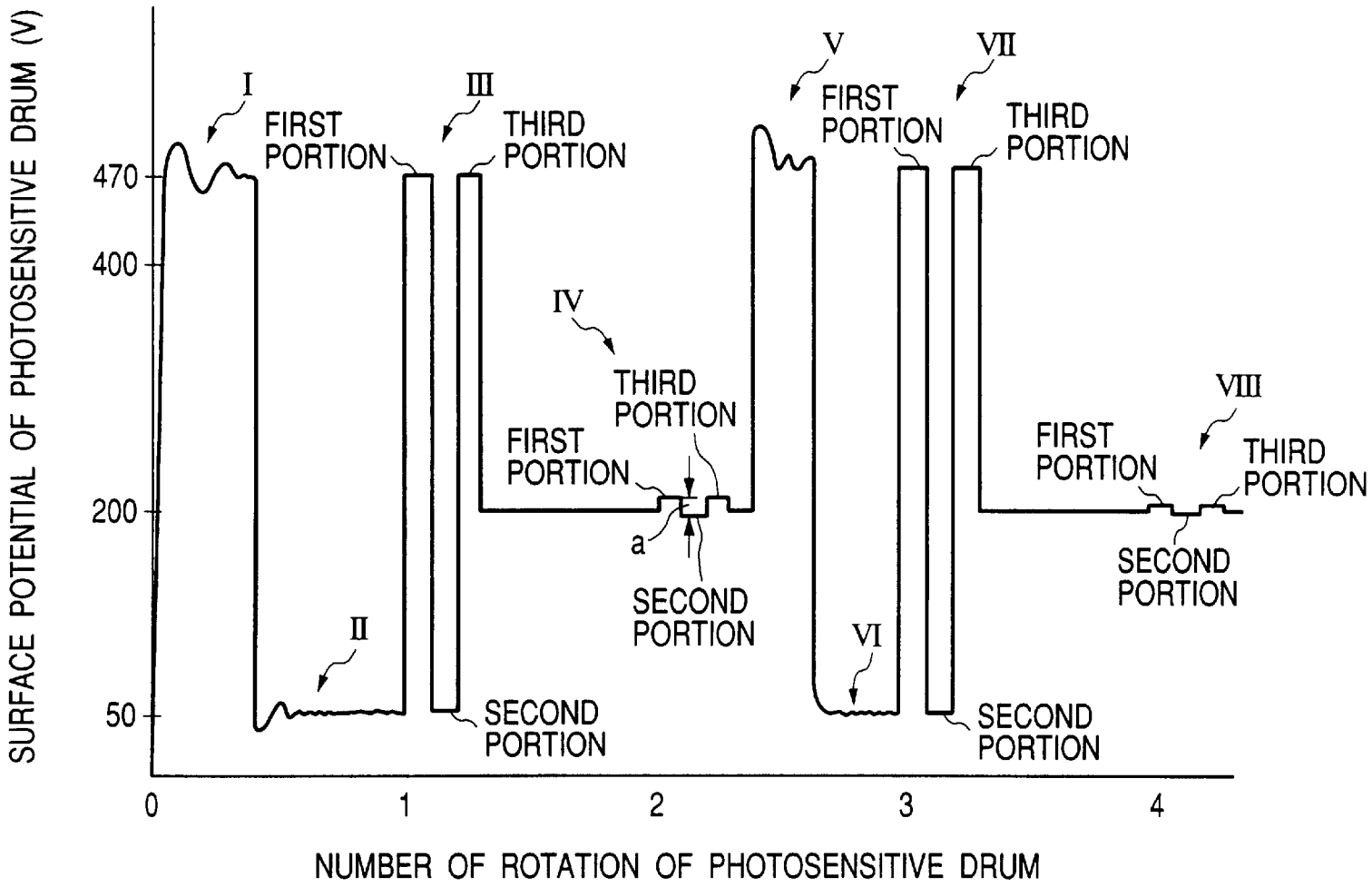
FIG. 3 is a graph showing the changes in the surface potential of the photosensitive drum when the control according to the first embodiment is effected.

The graph shown in FIG. 3 shows the surface potential of the photosensitive drum 1 detected by the potential sensor 111.

First, during the first closing of a power source switch, the pre-exposure light amount is fixed at the set value of an input voltage 20V, and a primary current value is fluctuated so that with the halogen lamp 103 turned off, the charging by the primary current of the primary charger 2 may assume the potential of dark portion 470V (I in FIG. 3).

Also, with the pre-exposure light amount and the primary current value fixed, the halogen lamp 103 is moved under a white plate 130 and is turned on. The light of this halogen lamp 103 is reflected by the white plate 130, and is applied to the photosensitive drum 1 through the intermediary of a mirror to thereby effect exposure. The setting control of fluctuating the turn-on voltage of the halogen lamp 103 to thereby set it to a turn-on voltage at which the potential of light portion becomes 50V while the potential on the photosensitive drum 1 at this time is read by the potential sensor 111 is effected (II in FIG. 3).

Under the conditions of the set primary current of the primary charger 2 and the image exposure amount of the halogen lamp 103, the halogen lamp 103 is then moved to the position of the white plate 130 which is outside the position of the original, and the halogen lamp 103 is turned off for 100 msec., and then is turned on for 100 msec., and then is turned off for 100 msec., whereby the first electrostatic latent image for detection is written onto the photosensitive drum 1 in the order of the potential of dark portion in the first portion, the potential of light portion in the second portion and the potential of dark portion in the third portion (III in FIG. 3). Next, the first to third portions are uniformly subjected to pre-exposure by the pre-exposure lamp 116.

Thereafter, in order to form halftone potential corresponding to one round or more of the photosensitive drum 1, the halogen lamp 103 is moved to the position of a halftone plate 131 which is outside the position of the original with the primary charger 2 remaining ON, and the halogen lamp 103 is turned on for 1.5 sec. The reflected light is uniformly applied to the first to third portions.

Potential difference detection is effected on this halftone potential, and the residual potential (indicated at IV in FIG. 3) on the first to third portions of the first electrostatic latent image for detection can be detected by the potential sensor 111.

If the value of the potential difference of the residual potential shown by a at IV in FIG. 3 is 5V or greater, the pre-exposure light amount changing control of increasing the input voltage inputted to the exposure lamp 116 by IV is effected and again, at V–VIII in FIG. 3, as at I–IV, setting control, potential detection and pre-exposure light amount changing control are repetitively effected until the value of the potential difference at a at IV in FIG. 3 becomes less than 5V.

Figure 7:
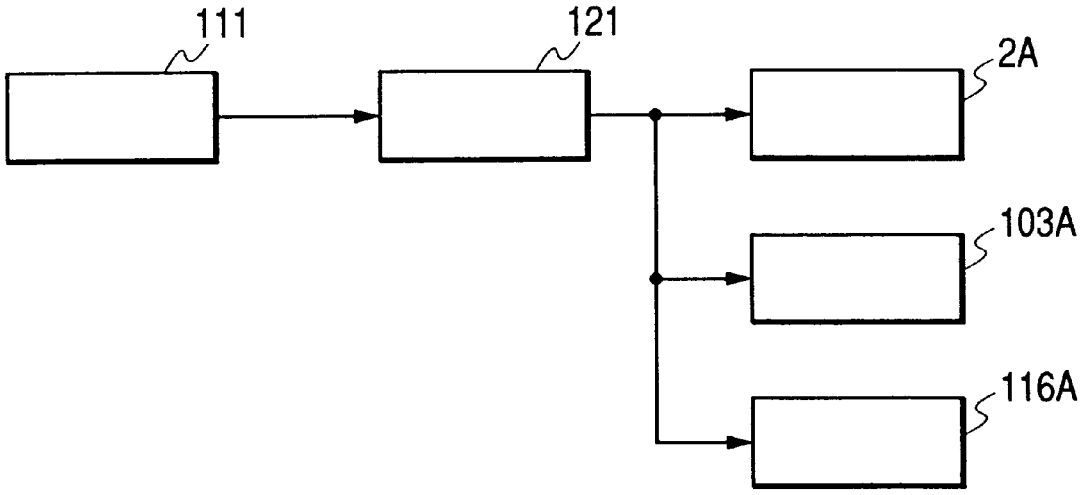
FIG. 7 is a control block diagram of an image forming apparatus.

FIG. 7 shows a control block diagram of the present apparatus, and the potential detection signal of the potential sensor 111 is inputted to a CPU 121, which controls the power source 2A of the charger 2, the power source 103A of the lamp 103 and the power source 116A of the lamp 116.

The reason why the control of gradually raising the pre-exposure light amount as described above is effected is that in order to set the suitable potential of the photosensitive drum when the pre-exposure light amount is raised, the primary current value of the primary charger 2 is made great to thereby raise the amount of charging of the photosensitive drum 1, but when the primary current value becomes great, the amount of ozone produced from the primary charger 2 increases.

When this amount of ozone increases and the ozone remains on the photosensitive drum 1, the electrostatic latent image thereon is disturbed and the image formed is deteriorated and therefore, in order to make the amount of ozone as small as possible, it is preferable that the current value of the charger 2 be small.

Accordingly, from this point of view, it is preferable that the pre-exposure amount be also as small as possible.

As described above, the pre-exposure amount is made great to such a degree that the irregularity (unevenness) of the residual potential falls within a predetermined range, but in order not to increase the amount of ozone produced by the charger 2, it is preferable that the pre-exposure amount be as small as possible and therefore, it is preferable to effect the above-described control of increasing the input voltage little by little.

When an image is formed by the use of the pre-exposure light amount, the primary current value and the image exposure amount set by this result, the evil that the image formed by the residual potential on the photosensitive drum 1 is aggravated does not occur and images of high quality can be provided.

Also, by the pre-exposure light amount being set to as small a pre-exposure light amount as possible, the amount of increase in the ozone produced can be made as small as possible to thereby prevent the deterioration of images, and images of high quality can be provided.

(Second Embodiment)

Figure 4:
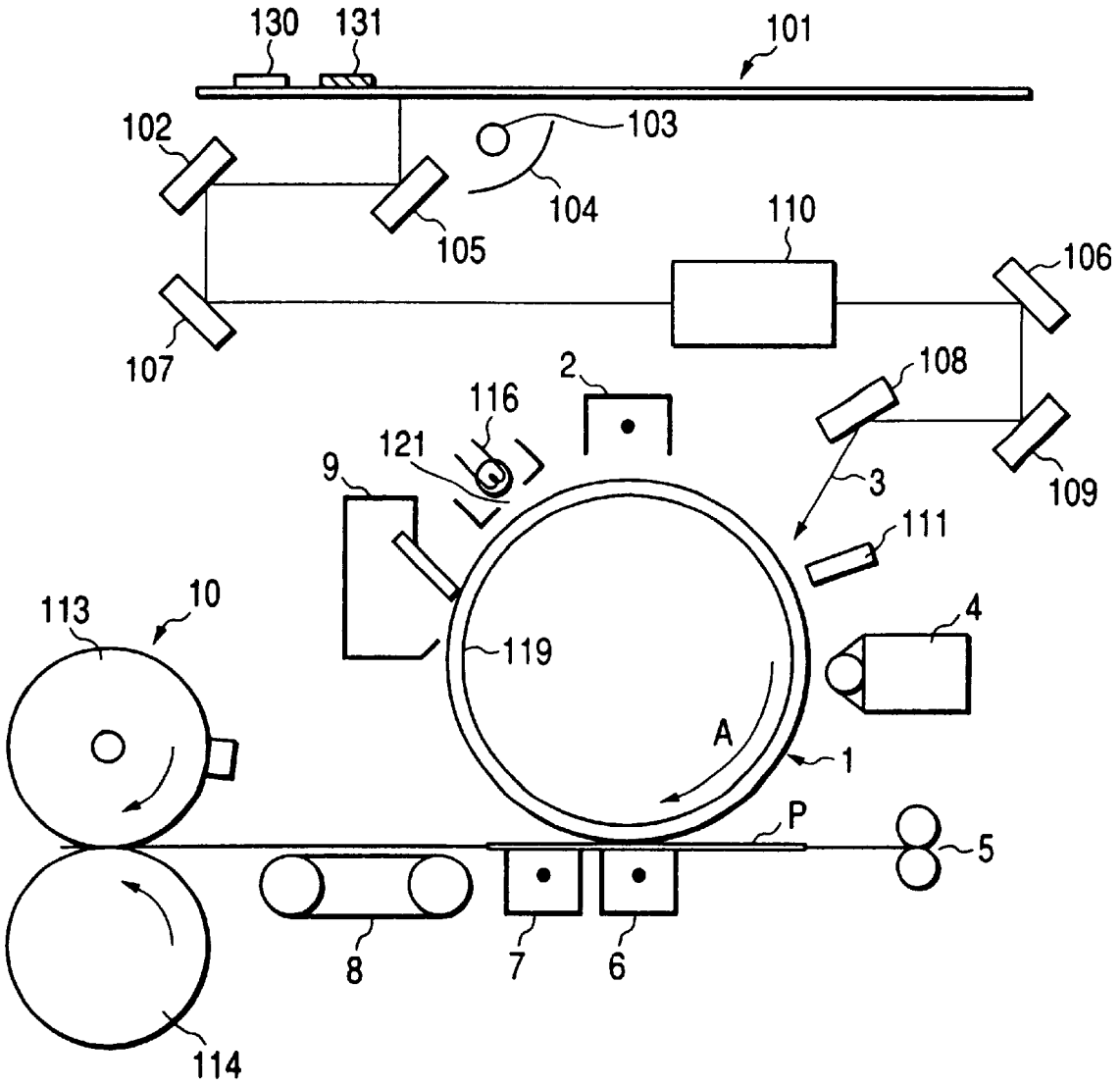
FIG. 4 schematically shows the construction of an image forming apparatus according to a second embodiment of the present invention.

FIG. 4 schematically shows the construction of an image forming apparatus according to a second embodiment of the present invention. In the above-described first embodiment, the input voltage of the pre-exposure lamp 116 is varied to thereby change the pre-exposure light amount, but in the present embodiment, design is made such that the light of the pre-exposure lamp 116 is passed through a slit and is applied to the photosensitive drum 1, and the width of the opening of this slit 121 is varied to thereby change the pre-exposure light amount.

The other constructions and action of the present embodiment are the same as those of the first embodiment and therefore, the same constituent portions are given the same reference numerals and the explanation of them is omitted.

In FIG. 4, the reference numeral 1 designates a photosensitive drum, the reference numeral 2 denotes a primary charger, the reference numeral 3 designates optical image exposure, the reference numeral 4 denotes a developing device, the reference numeral 5 designates a conveying path, the reference numeral 6 denotes a transfer charger, the reference numeral 7 designates a separating charger, the reference numeral 8 denotes a conveying portion, the reference numeral 9 designates a cleaner, and the reference numeral 10 denotes a fixing device. In the present embodiment, the process speed is 300 mm/sec., and the diameter of the photosensitive drum 1 is 100 mm.

In the present embodiment, a slit 121 for passing the light of the pre-exposure lamp 116 therethrough is provided between the pre-exposure lamp 116 and the photosensitive drum 1.

The width of the opening of this slit 121 is set to a basic value of 2 mm, and the slit can emit a quantity of light of 4.0 [lux·sec.] and if the width of the opening thereof is increased by 1 mm, the quantity of light rises by 1.0 [lux·sec.].

So, in the pre-exposure light amount changing control of the present embodiment, the width of the opening of the slit 121 is increased by 1 mm when the potential difference of the residual potential is 5V or greater.

Next, when the pre-exposure light amount is increased by the pre-exposure light amount changing control, return is made to the setting control and the potential of dark portion and the potential of light portion are read by the potential sensor 111, and the image exposure amount of the halogen lamp 103 and the amount of charging of the primary charger 2 are changed so that this potential may become predetermined potential, whereby ideal potential is formed.

As the result of this pre-exposure light amount having been increased, the amount of charging of the primary charger 2 is raised to thereby ensure the potential of dark portion, and the potential difference of the residual potential always becomes small and image formation of high accuracy becomes possible.

Thereafter, as in the first embodiment, a first electrostatic latent image for detection is formed in the order of the potential of dark portion, the potential of light portion and the potential of dark portion, and the potential detecting control of reading the potential difference of the residual potential on the photosensitive drum 1 after one round on which a second electrostatic latent image of halftone potential for detection has been formed by the potential sensor 111 is effected.

By the use of such control as described above, potential detection and pre-exposure light amount changing control are repetitively effected from setting control so that image formation can be effected after the setting has been finished so that the potential difference of the residual potential detected by potential detection may be within 5V.

When an image is formed by the use of the pre-exposure light amount, the primary current value and the image exposure amount set by this result, the evil that the image formed by the residual potential on the photosensitive drum 1 is aggravated does not occur and images of high quality can be provided.

(Third Embodiment)

Figure 5:
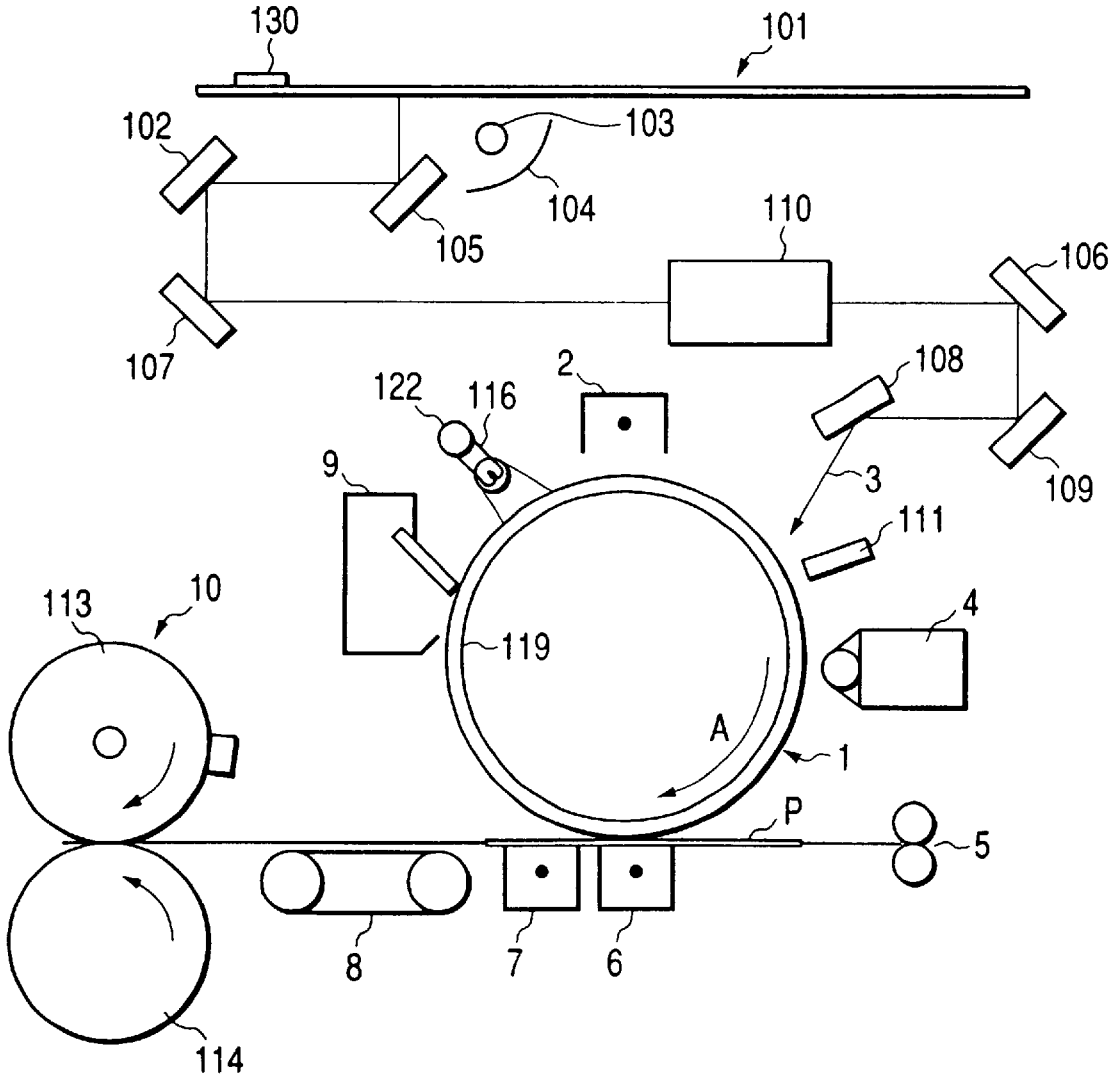
FIG. 5 schematically shows the construction of an image forming apparatus according to a third embodiment of the present invention.
Figure 6:
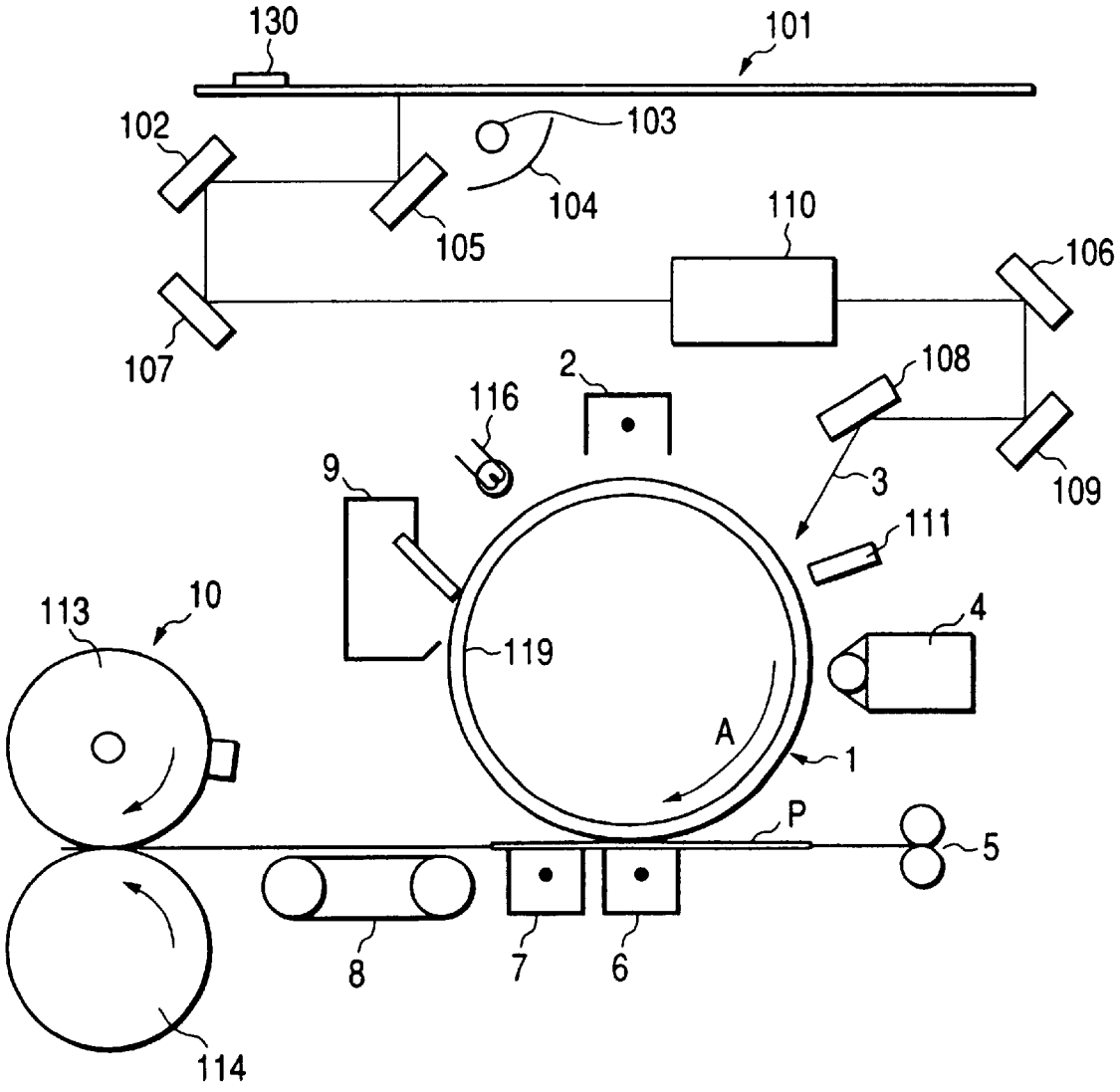
FIG. 6 PRIOR ART
FIG. 6 schematically shows the construction of an image forming apparatus according to the prior art.

FIG. 5 schematically shows the construction of an image forming apparatus according to a third embodiment of the present invention. In the present embodiment, the angle of irradiation of the pre-exposure lamp 116 is varied to thereby change the pre-exposure light amount.

The other constructions and action of the present embodiment are the same as those of the first embodiment and therefore, the same constituent portions are given the same reference numerals and the explanation of them is omitted.

In FIG. 5, the reference numeral 1 designates a photosensitive drum, the reference numeral 2 denotes a primary charger, the reference numeral 3 designates optical image exposure, the reference numeral 4 denotes a developing device, the reference numeral 5 designates a conveying path, the reference numeral 6 denotes a transfer charger, the reference numeral 7 designates a separating charger, the reference numeral 8 denotes a conveying portion, the reference numeral 9 designates a cleaner, and the reference numeral 10 denotes a fixing device.

In the present embodiment, the process speed is 300 mm/sec., and the diameter of the photosensitive drum 1 is 100 mm.

In the present embodiment, the pre-exposure lamp 116 is supported by the center of pivotal movement 122, and by the pre-exposure lamp 116 itself being pivotally moved, the angle of irradiation of light of the pre-exposure lamp 116 indicated by dotted line is changeable.

A case where the angle of irradiation of this pre-exposure lamp 116 is inclined by 10° toward the cleaner 9 side with respect to the line from the center of pivotal movement 122 toward the center of the photosensitive drum 1 is defined as a basic position, and at that position, the pre-exposure lamp 116 can emit a quantity of light of 4.0 [lux·sec.], and by the angle of irradiation being inclined toward the primary charger 2 side, there appears an effect similar to the effect that the quantity of light affecting image formation becomes great.

So, in the pre-exposure light amount changing control of the present embodiment, the angle of irradiation is inclined by 10° toward the primary charger 2 side when the potential difference of the residual potential is 5V or greater.

Next, when the pre-exposure light amount is raised by the pre-exposure light amount changing control, return is made to the setting control, and the potential of dark portion and the potential of light portion are read by the potential sensor 111, and the image exposure amount of the halogen lamp 103 and the amount of charging of the primary charger 2 are changed so that this potential may become predetermined potential, whereby ideal potential is formed.

As the result of this pre-exposure light amount having been raised, the amount of charging of the primary charger 2 is raised to thereby ensure the potential of dark portion, and the potential difference of the residual potential always becomes small and image formation of high accuracy becomes possible.

Thereafter, as in the first embodiment, a first electrostatic latent image for detection is formed in the order of the potential of dark portion, the potential of light portion and the potential of dark portion, and the potential detection of reading the residual potential on the photosensitive drum 1 after one round on which a second electrostatic latent image of halftone potential for detection has been formed by the potential sensor 111 is effected.

In the present embodiment, the halogen lamp 103 is turned off and the primary current of the primary charger 2 is outputted at a value of ½ of a value set to form the potential of dark portion to thereby form halftone potential. On this halftone potential, the residual potential is detected by the potential sensor.

By the use of such control as described above, potential detection and pre-exposure light amount changing control are repetitively effected from setting control so that image formation can be effected after the setting has been finished so that the potential difference of the residual potential detected by potential detection may be within 5V.

When an image is formed by the use of the pre-exposure light amount, the primary current value and the image exposure amount set by this result, the evil that the image formed by the residual potential on the photosensitive drum does not occur and images of high quality can be provided.

What is claimed is:

1. An electrophotographic apparatus comprising:

a photosensitive member;

an electrostatic image forming means for forming an electrostatic image on said photosensitive member, said electrostatic image forming means including charging means for charging said photosensitive member, and image exposure means for effecting image exposure on said photosensitive member charged by said charging means;

pre-exposure means for pre-exposing said photosensitive member before said photosensitive member is charged by said charging means; and detecting means for detecting a surface potential of said photosensitive member;

wherein said apparatus is provided with a sequence in which a dark portion and a light portion are formed on a first portion and a second portion, respectively, on said photosensitive member by said electrostatic image forming means, whereafter said first portion and said second portion are exposed by said pre-exposure means, and then said first portion and said second portion are charged by said charging means, and then the surface potentials of said first portion and said second portion are detected by said detecting means, and an exposure amount at which said photosensitive member is exposed by said pre-exposure means is controlled in conformity with the potential of said first portion and the potential of said second portion detected by said detecting means in said sequence.

2. An electrophotographic apparatus according to claim 1, wherein, in said sequence, said first portion and said second portion are brought into a potential between the surface potential of said dark portion and the surface potential of said light portion after they are exposed by said pre-exposure means and before the surface potential is detected by said detecting means.

3. An electrophotographic apparatus according to claim 2, wherein, in said sequence, said first portion and said second portion are brought into a halftone potential after they are exposed by said pre-exposure means and before the surface potential is detected by said detecting means.

4. An electrophotographic apparatus according to claim 3, wherein a charging output of said charging means is smaller when said halftone potential is formed than that when said potential of dark portion is formed.

5. An electrophotographic apparatus according to claim 3, wherein said halftone potential is formed by use of reflected light when said image exposure means irradiate light to a reflecting portion of halftone.

6. An electrophotographic apparatus according to claim 1, wherein the surface potential of said dark portion and the surface potential of said light portion are detected by said detecting means before said sequence is carried out, and an amount of charging at which said photosensitive member is charged by said charging means and an exposure amount at which said photosensitive member is image-exposed by said image exposure means are controlled on the basis of the surface potential of said dark portion and the surface potential of said light portion detected by said detecting means.

7. An electrophotographic apparatus according to claim 1, wherein, when the exposure amount by said pre-exposure means is changed in conformity with the potential of said first portion and the potential of said second portion detected by said detecting means, the surface potential of the dark portion of said photosensitive member and the surface potential of the light portion of said photosensitive member are detected by said detecting means, and an amount of charging at which said photosensitive member is charged by said charging means and an exposure amount at which said photosensitive member is image-exposed by said image exposure means are controlled on the basis of the surface potential of said dark portion and the surface potential of said light portion detected by said detecting means, and then said sequence is repeated.

8. An electrophotographic apparatus according to claim 1, wherein when in said sequence, a potential difference between the potential of said first portion and the potential of said second portion detected by said detecting means is greater than a predetermined value, the exposure amount at which said photosensitive member is exposed by said pre-exposure means is increased and also, an amount of charging at which said photosensitive member is charged by said charging means is increased.

9. An electrophotographic apparatus according to claim 1, wherein said pre-exposure means is provided with a light source, and a changing of the exposure amount at which said photosensitive member is exposed by said pre-exposure means is effected by changing a voltage applied to said light source.

10. An electrophotographic apparatus according to claim 1, wherein said pre-exposure means is provided with a light source and a regulating member for regulating a light irradiation width of said light source, and a changing of the exposure amount at which said photosensitive member is exposed by said pre-exposure means is effected by changing the light irradiation width by said regulating member.

11. An electrophotographic apparatus according to claim 1, wherein a changing of the exposure amount at which said photosensitive member is exposed by said pre-exposure means is effected by changing a light irradiating position at which light is irradiated from said pre-exposure means to said photosensitive member.

* * * * *